United States Patent [19]

Nilssen

[11] Patent Number: 4,835,915

[45] Date of Patent: Jun. 6, 1989

[54] INDIRECT OFFICE LIGHTING SYSTEM

[76] Inventor: Ole K. Nilssen, Caesar Dr., Barrington Hills, Ill. 60010

[21] Appl. No.: 922,745

[22] Filed: Oct. 24, 1986

[51] Int. Cl.[4] ..... F21S 1/14; E04F 17/08

[52] U.S. Cl. ..... 52/28; 52/220; 362/147; 439/207

[58] Field of Search ..... 52/28, 29, 220; 362/217, 127, 147; 339/21 R, 22 R, 22 B

[56] References Cited

U.S. PATENT DOCUMENTS

| | | | |
|---|---|---|---|
| 3,353,016 | 11/1967 | Robinson | 362/217 |
| 3,389,246 | 6/1968 | Shemitz | 362/147 |
| 3,605,064 | 9/1971 | Routh et al. | 339/21 R |
| 4,207,498 | 6/1980 | Spira et al. | 315/97 |
| 4,217,018 | 8/1980 | Yoshida et al. | 339/21 R |
| 4,229,782 | 10/1980 | Ruud et al. | 362/297 |
| 4,344,111 | 8/1982 | Ruud et al. | 362/33 |
| 4,350,935 | 9/1982 | Spira et al. | 315/291 |
| 4,370,008 | 1/1983 | Haworth et al. | 339/4 |
| 4,377,724 | 3/1983 | Wilson | 174/48 |
| 4,414,617 | 11/1983 | Galindo | 362/404 |
| 4,441,055 | 4/1984 | Balchjunas et al. | 315/288 |
| 4,591,764 | 5/1986 | Nilssen | 315/312 |
| 4,591,957 | 5/1986 | Harwood | 362/148 |
| 4,602,448 | 7/1986 | Groove | 40/541 |
| 4,626,747 | 12/1986 | Nilssen | 315/209 R |
| 4,631,648 | 12/1986 | Nilssen | 362/150 |
| 4,688,154 | 8/1987 | Nilssen | 362/147 |

FOREIGN PATENT DOCUMENTS

| | | | |
|---|---|---|---|
| 2915477 | 10/1980 | Fed. Rep. of Germany | 339/22 R |

*Primary Examiner*—Michael Safavi

[57] ABSTRACT

An office wall partition includes a central electronic high-frequency power supply as well as a main fluorescent lamp. The power supply is removably comprised within the partition; and the main fluorescent lamp is inserted into and held by a pair of sockets connected with the power supply by way of a high frequency ballast and mounted within a long narrow compartment on top of the partition. The width of this compartment is only about 2.5", which is about the same as the thickness of a standard office partition; and its length is nearly 6', which is nearly the same as the width of a standard office partition. The fluoresent lamp emits the light upward in the form of a beam of approximately 120 degree spread, thereby providing for glare-free ambient illumination reflected off the ceiling. Power track means and receptacle means mounted on the partition are connected with the power supply and provide for the cost-effective operation of various incandescent and/or fluorescent task lighting modules.

20 Claims, 2 Drawing Sheets

INDIRECT OFFICE LIGHTING SYSTEM

BACKGROUND OF THE INVENTION

1. Field of Invention

The present invention relates to office wall partitions having integral lighting means:

(i) particularly of a type wherein a partition comprises an integral electronic power supply as well as one or more fluorescent and/or incandescent lighting means powered from this power supply, and (ii) more particularly of a type wherein this partition has a long and narrow fluorescent lighting means integrally combined with its upper portion in such a manner as to beam light toward the ceiling, thereby to provide indirect ambient illumination by way of reflection from the ceiling.

2. Elements of Prior Art

While ceiling-directed fluorescent lighting is sometimes used in connection with office wall partition systems, the means available for doing so are quite orthodox and clumsy. Typically, a more-or-less ordinary multi-lamp fluorescent lighting fixture is mounted on top of a cabinet integrated with the wall partition system. The light from this fixture is directed toward the ceiling, and ambient illumination results from reflections off the ceiling.

SUMMARY OF THE INVENTION

Objects of the Invention

A basic object of the present invention is that of providing an improved office wall partition means.

A more specific object is that of providing a wall partition system comprising integral lighting means.

These, as well as other objects, features and advantages of the present invention will become apparent from the following description and claims.

Brief Description

In its basic preferred embodiment, the present invention constitutes a floor-mounted wall partition of ordinary thickness (about 2.5") and height (about 6'). This partition comprises means for accepting and holding a high-frequency electronic power supply means as well as one or more fluorescent and/or incandescent lighting means powered from this power supply means.

In particular, the partition comprises: (i) power line terminal means operative to permit connection with an ordinary electric utility power line, (ii) frequency-converting power supply having high frequency output terminals and being mounted in such manner as to be concealed within the body of the partition, (iii) reflective lamp holder means located along the upper part of the partition and operative to receive and hold a relatively long and thin fluorescent lamp in such manner as to be concealed within the body of the partition except for being visible through an aperture along the top of the partition, (iv) lamp matching means connected with lamp sockets in the lamp holder means; (v) power track means located on the side of the partition and operative to receive, hold and power one or more fluorescent and/or incandescent task lighting means, (vi) interconnection means operative to permit electrical interconnection with an adjacently positioned partition, and (vii) wiring means operative to connect the power line terminal means with the power supply as well as to connect the high frequency output terminals with the lamp matching means, the power track means, and the interconnection means.

When in use, the partition would be connected with the power line, and high frequency power would be provided to the lamp matching means (and thereby to the fluorescent lamp), to the power track means, and to the interconnection means. Ambient lighting would be provided by way of light emitted upward from the fluorescent lamp and reflected off the ceiling; task lighting would be provided by a fluorescent and an incandescent task lighting means supported by and powered from the power track means; and high frequency power would be provided to an adjacent partition, thereby to power similar lighting and other functions associated with that partition.

DESCRIPTION OF THE PREFERRED EMBODIMENT

Details of Construction

FIGS. 1 to 4 illustrate the physical arrangement of the preferred embodiment of the present invention.

An office wall partition OWP has an opening covered with a removable panel RP. A frequency-converting power supply FCPS is located behind the removable panel and has a power cord PC operative by way of power plug PP to be plugged into an ordinary electric power receptacle. The power cord passes through an opening at the side of the removable panel.

A high frequency distribution cable HFDC, which is connected with the output of power supply FCPS, is located within partition OWP and is connected with: (i) a first and a second high frequency receptacle means HFRM1 and HFRM2, (ii) power track means PTM, and (iii) main high frequency ballast MHFB.

Main high frequency ballast MHFB is connected with fluorescent lamp sockets FLS1 and FLS2; and a main fluorescent lamp MFL is inserted into and held by these lamp sockets.

Plugged into and held by the power track means is a fluorescent task lighting means FTLM and an incandescent task lighting means ITLM.

The top part of the partition comprises a parabolically-shaped reflector means PSRM placed underneath main fluorescent lamp MFL. A transparent cover means TCM provides a cover above the main fluorescent lamp and forms part of the top surface of the partition.

Mounted adjacently on the right-hand side of partition OWP is another office wall partition OWPx; which adjacent partition comprises several of the same items as does partition OWP: a main high frequency ballast MHFBx, a pair of fluorescent lamp sockets FLS1x and FLS2x, a main fluorescent lamp MFLx, power track means PTMx, a high frequency receptacle means HFRM2x, and a high frequency distribution cable HFDCx.

High frequency distribution cable HFDCx receives high frequency voltage by way of a high frequency power plug HFPP plugged into receptacle means HFRM2 of partition OWP.

Figure 5:
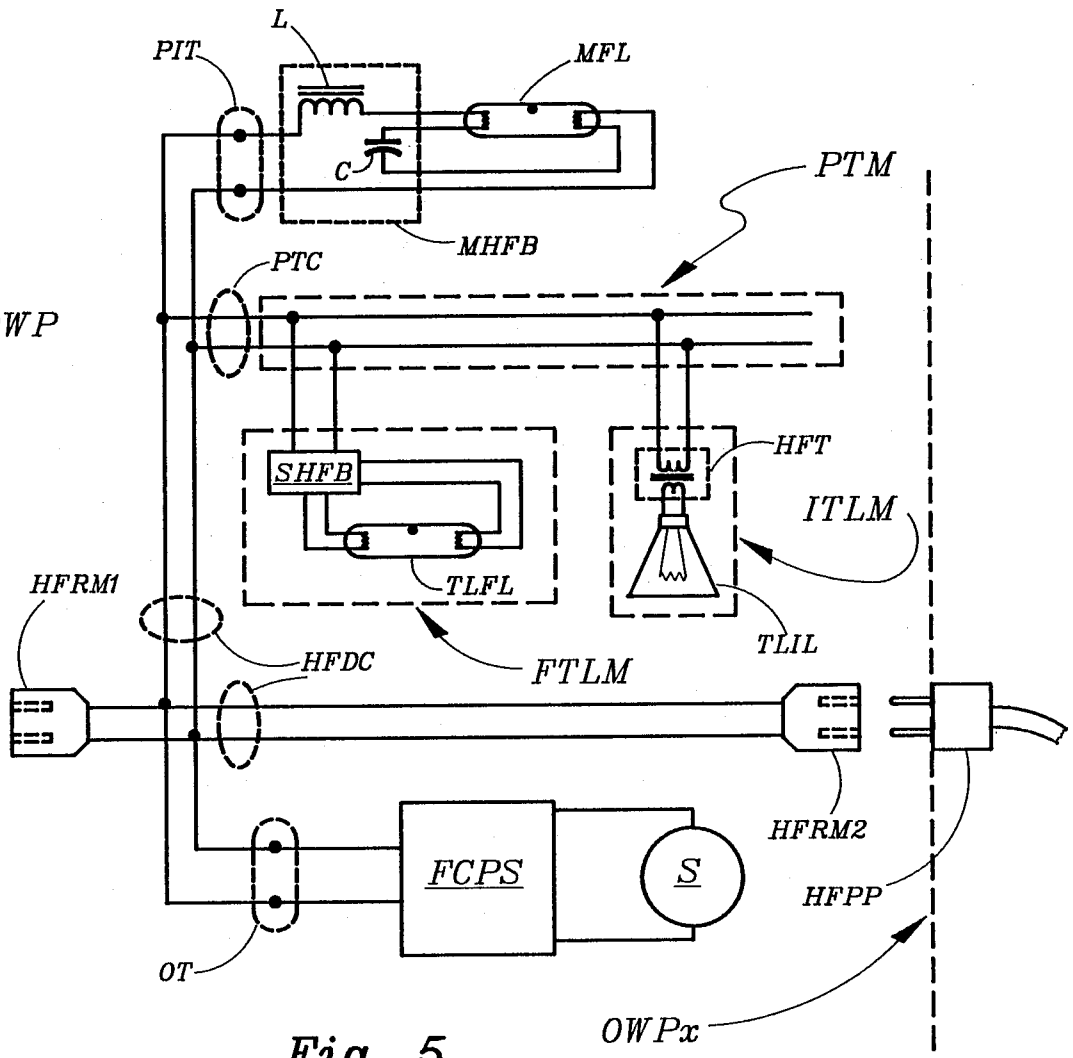
FIG. 5 provides an electrical circuit diagram of the preferred embodiment of the present invention.

FIG. 5 illustrates the electrical arrangement of the preferred embodiment of the invention.

In FIG. 5, a source S, which represents an ordinary electric utility power line, is connected with frequency-converting power supply FCPS; the output of which power supply is provided across output terminals OT and constitutes an AC voltage of frequency around 30 kHz and magnitude around 120 Volt RMS.

Output terminals OT are connected with two distribution conductors in high frequency distribution cable HFDC; which distribution conductors are connected with: (i) power input terminals PIT of main high frequency ballast MHFB, (ii) power track conductors PTC of power track means PTM, and (iii) high frequency receptacle means HFRM1 and HFRM2.

Main high frequency ballast MHFB comprises an inductor L and a capacitor C, which are series-connected across power input terminals PIT by way of thermionic cathodes TC1 and TC2 of main fluorescent lamp MFL.

A secondary high frequency ballast SHFB is connected in circuit between power track conductors PTC and the cathode terminals of a task light fluorescent lamp TLFL. Secondary ballast SHFB and task light fluorescent lamp TLFL are comprised within fluorescent task lighting means FTLM.

A high frequency transformer HFT is connected in circuit between power track conductors PTC and the filament of a task light incandescent lamp TLIL. Transformer HFT and task light incandescent lamp TLIL are comprised within incandescent task lighting means ITLM.

A high frequency power plug HFPP from adjacent partition OWPx is shown in position to connect with high frequency receptacle means HFRM2.

Details of Operation

The operation of the office wall partition of the present invention is explained as follows.

The frequency-converting power supply is adapted to connect with an ordinary electric utility line and, when so connected, is operative to provide a 120 Volt/30 kHz voltage to a high frequency distribution cable (HFDC), and thereby to several load points: (i) a main high frequency ballast (MHFB), (ii) a power track means (PTM), and (iii) a pair of high frequency receptacle means (HFRM1 and HFRM2).

A long (64") and slim ($\frac{3}{4}$" or T-6) fluorescent lamp (MFL) is powered by the main high frequency ballast (MHFB). This lamp is positioned in a parabolic-like reflector located in a compartment at the top of an office wall partition (OWP). This compartment has an aperture aimed upward; which aperture is covered by a transparent cover means (TCM). The compartment, the reflector, the lamp, and the cover means are so arranged and constituted as to cause substantially all the light from the lamp to be aimed toward the ceiling, thereby to provide ambient illumination by way of light reflected off the ceiling.

Office wall partition OWP may be connected with one or more other office wall partitions (Ex. OWPx) by way of receptacle means HFRM1 and/or HFRM2, thereby to provide 120 Volt/30 kHz voltage from the frequency-converting power supply (FCPS in OWP) to various load points in these other partitions. In particular, the adjacently placed office wall partition OWPx has a fluorescent lamp located in a compartment at its top; and this fluorescent lamp is powered from the frequency-converting power supply (FCPS) in office wall partition OWP.

The power track mounted on the outside of office wall partition OWP is useful for holding and/or powering various items, such as task lighting means. In particular, it is shown as holding and powering a fluorescent task lighting means (FTLM) and an incandescent task lighting means (ITLM).

Additional Comments (a) Depending on the exact positioning of the fluorescent lamp relative to the parabolic reflector means (PRM), the light emitted from the top part of the office wall partition can be adjusted in terms of beam-width and/or in terms of angle from the vertical.

(b) Office wall partition OWP may be considered a master partition; and office wall partition OWPx may be considered a slave partition. Any number of slave partitions may be powered from a single master partition by way of having the slave partitions plugged into one another.

Figure 1:
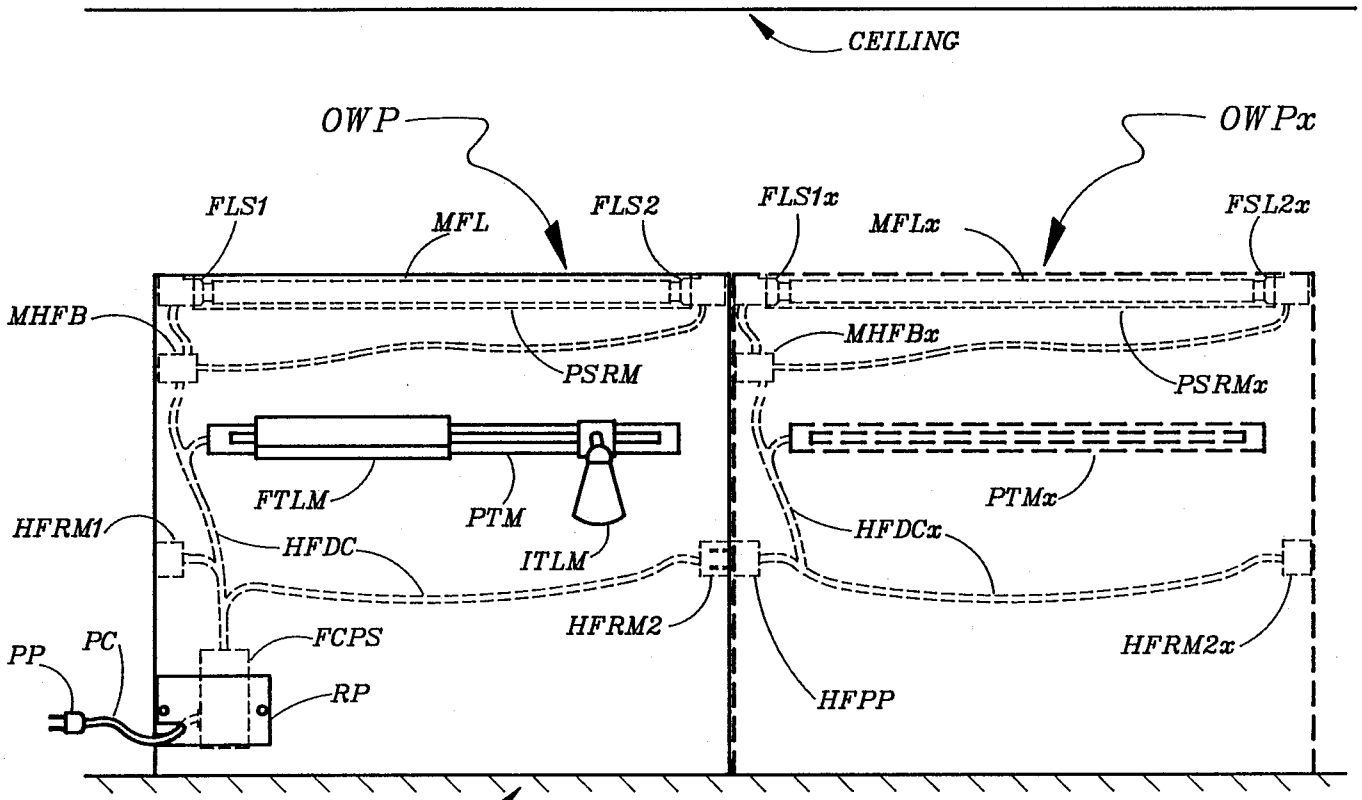
FIG. 1 provides a view from the front of the preferred embodiment of the partition of the present invention.
Figure 2:
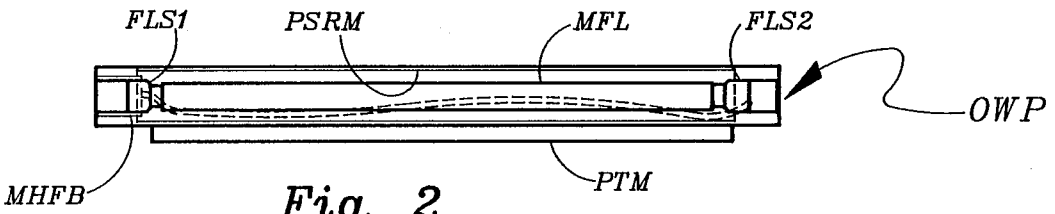
FIG. 2 provides a view from the top of the preferred embodiment of the partition of the present invention.
Figure 3:
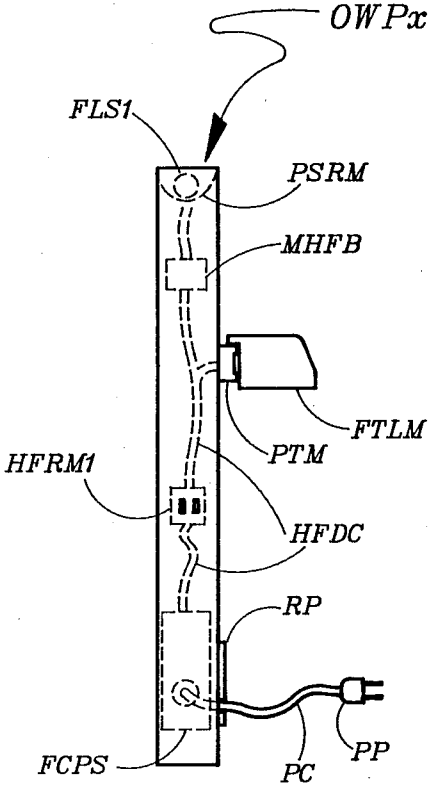
FIG. 3 provides a view from the left side of the preferred embodiment of the partition of the present invention.

(c) Instead of being more-or-less flat and rectangularly shaped, as indicated in FIGS. 1–3, the partitions may be shaped in various less regular ways. For instance, a partition may be curved; in which case the fluorescent lamp means located on its top side would have to be made to conform to the curvature of the partition.

(d) Instead of using a single fluorescent lamp in the lighting means located on top of the partitions, as indicated in FIGS. 1–3, two or more individual fluorescent lamps may be used, in series-connected configuration or in other ways. In case of a curved partition, it would seem particularly apropos to use several relatively short series-connected fluorescent lamps instead of the single relatively long fluorescent lamp of FIGS. 1–3.

(e) The fluorescent lamp used in the lighting means located at the top of partition OWF of FIGS. 1–3 is a high output fluorescent lamp. However, to get an even higher degree of light output, so-called extra high output lamps may be used.

(f) In fact, for even more light output, medium-pressure or high-pressure gas discharge lamps may be used for providing the ceiling-directed light from the top of partition OWP; in which case it would not normally be necessary to use the complete top part of the partition as an aperture for light flux.

Figure 4:
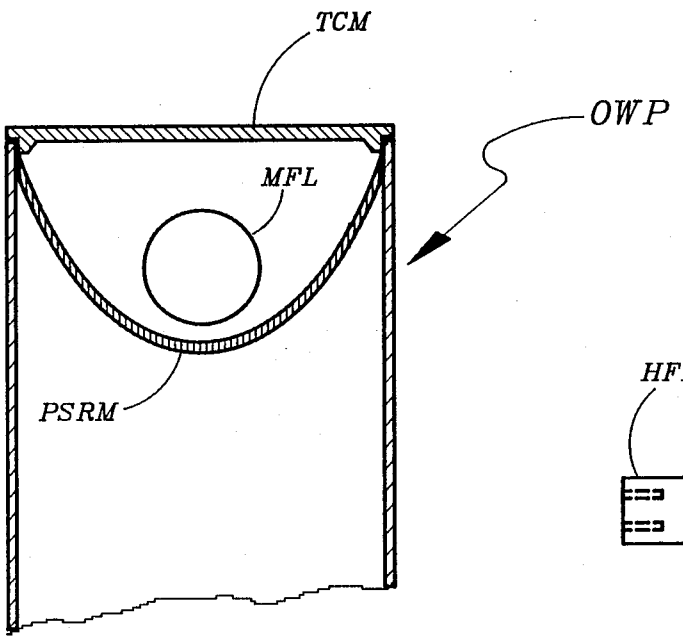
FIG. 4 provides a view of a cross-section of the middle part of the upper portion of the partition.

(g) For improved optical control, extra thin fluorescent lamps may be used in lieu of the T-6 lamp shown in FIG. 4. For instance, it would be entirely feasible to use one or more (straight or curved) pieces of T-4 lamps of the type presently used in connection with the so-called PL lamp from North American Philips Corporation.

(h) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. A partition means adapted for partitioning use in an office or similar location and operative to provide at least partial enclosure of an area within this office or similar location, the office or similar location having a floor and a ceiling, the partition means: (i) having a shape that is characterized as substantially being a rectangular prism having two of its mutually parallel rectangular surfaces separated by a distance that is very much smaller than the longest dimension of one of these surfaces, (ii) being positioned on the floor in such manner that a substantially straight vertical line may be drawn on one of the mutually parallel rectangular surfaces, (iii) having a height substantially less than that of the ceiling, and (iv) comprising:

terminal means operative to connect with an ordinary electric utility power line and to provide in a substantially unaltered form, at a primary output means, the power line voltage from the ordinary electric utility power line;

altering means connected between the primary output means and a secondary output means, the altering means being: (i) at least in part, contained within the mutually parallel surfaces, and (ii) operative to provide at the secondary output means a conditioned output voltage that is substantially altered in at least one of its electrical characteristics with respect to the corresponding characteristic of the unaltered power line voltage; and lighting means connected with the conditioned output and operative to be properly powered therefrom, the lighting means being located within the two mutually parallel rectangular surfaces and operative to emit its light principally toward the ceiling.

2. The partition means of claim 1 wherein the lighting means comprises a fluorescent lamp operative to emit light through an aperture in the partition means.

3. The partition means of claim 2 wherein the fluorescent lamp is oriented in a substantially horizontal manner.

4. The partition means of claim 1 wherein the altering means comprises frequency conversion means, thereby to cause the conditioned output voltage to be of a frequency substantially different from that of the power line voltage.

5. The partition means of claim 1 additionally comprising power track means connected with the secondary output means, the power track means being operative to receive, hold, and disconnectably connect with load means, thereby to provide the conditioned output voltage to said load means.

6. The partition means of claim 2 having a top surface comprising optical aperture means, the optical aperture means being operative to permit light flux originating from within the partition means to exit therefrom.

7. The partition means of claim 1 additionally comprising means operative to make the partition means movable, thereby permitting the partition means to be relocated within the office and similar location as well as altogether removed from the office and similar location.

8. A movable room partitioning means having substantially the shape of a rectangular prism with a first, second and third pair of mutually parallel surfaces, one of the surfaces of the first pair of mutually parallel surfaces being disposed vertically and having an area that is very large as compared with any of the areas of the surfaces of the second and third pair of mutually parallel surfaces, the surfaces of the second pair of mutually parallel surfaces being disposed horizontally, the movable partitioning means comprising:

internal space bounded by the first, second and third pair of mutually parallel surfaces, one of the surfaces of the second pair of surfaces comprises an optical aperture means;

conditioning means located at least in part within the internal space, the conditioning means having connect means operative to connect with an ordinary electric utility power line and being, when so connected, operative to condition the power line voltage then provided by the power line in such manner as to provide at a secondary output a conditioned voltage, the conditioned voltage being different from the power line voltage in at least one substantial characteristic, such as frequency, magnitude, phase, or power availability; and lighting means located within the internal space and connected with the secondary output, the lighting means being operative to emit light flux through the optical aperture means.

9. The room partitioning means of claim 8 wherein the conditioned voltage is of frequency substantially different from that of the power line voltage.

10. The room partitioning means of claim 8 wherein the lighting means comprises a fluorescent lamp and a ballasting means, both connected in circuit with the secondary output.

11. The room partitioning means of claim 10 wherein the frequency of the conditioned voltage is substantially higher than that of the power line voltage.

12. The room partitioning means of claim 8 additionally comprising power track means having track conductors connected with the secondary output, the power track means being accessible from outside the internal space and operative to receive, hold, and provide the conditioned voltage to a number of load means located outside of the internal space.

13. The room partitioning means of claim 8 additionally comprising receptacle means connected with the secondary output, thereby to permit an auxiliary load located outside of the internal space, such as another room partitioning means, to be powered from the conditioned voltage.

14. A combination comprising:

(a) a first movable room partitioning means comprising:

an internal space bounded by an outer surface;

conditioning means located at least in part within the internal space, the conditioning means having connect means operative to connect with an ordinary electric utility power line and being, when so connected, operative to condition the power line voltage then provided by the power line in such manner as to provide at a secondary output a conditioned voltage, the conditioned voltage being different from the power line voltage in at least one substantial characteristic, such as frequency, magnitude, phase, or power availability; and receptacle means connected with the secondary output and operative to provide the conditioned voltage thereat; and (b) a second movable room partitioning means comprising:

plug means operative to connect with the receptacle means of the first partitioning means and to provide the conditioned voltage at a tertiary output; and load means connected with the tertiary output.

15. The combination of claim 14 wherein the first movable room partitioning means additionally comprises lighting means located at least in part within the internal space and connected with the secondary output, the lighting means being operative to emit light through an optical aperture located on the outer surface.

16. The combination of claim 14 wherein the load means comprises lighting means.

17. The combination of claim 16 wherein: (i) the second movable partitioning means comprises a second internal space bounded by a second outer surface, and (ii) the lighting means is at least partly comprised within this second internal space.

18. The combination of claim 14 wherein said conditioned voltage is of frequency substantially higher than that of the power line voltage.

19. In a movable room partitioning means having the shape of a rectangular prism, the rectangular prism having a first, second and third pair of mutually parallel surfaces, the first and third pair of mutually parallel surfaces being disposed vertically, the second pair of mutually parallel surfaces being disposed horizontally, the rectangular prism having an internal space, the improvement comprising:

frequency conversion means located within the internal space and operative: (i) to connect with an ordinary electric utility power line, and (ii) to provide at a secondary output an AC voltage of frequency substantially higher than that of the voltage on the power line; and lighting means connected with the secondary output and located within the internal space, the lighting means being operative to shine light onto objects outside of the internal space through an optical aperture in one of the surfaces of the second pair of mutually disposed surfaces.

20. The improvement of claim 19 wherein the first pair of mutually parallel surfaces are separated by a distance that is very much smaller than the longest substantially straight-line dimension of one of the surfaces of the first pair of mutually parallel surfaces.

* * * * *